US009266232B2

(12) United States Patent
Hernandez, Jr.

(10) Patent No.: US 9,266,232 B2
(45) Date of Patent: Feb. 23, 2016

(54) ADJUSTABLE T-WRENCH

(71) Applicant: ALLTRADE TOOLS LLC, Long Beach, CA (US)

(72) Inventor: Hector R. Hernandez, Jr., Fullerton, CA (US)

(73) Assignee: ALLTRADE TOOLS INC., Long Beach, CA (US)

( * ) Notice: Subject to any disclaimer, the term of this patent is extended or adjusted under 35 U.S.C. 154(b) by 248 days.

(21) Appl. No.: 14/146,640

(22) Filed: Jan. 2, 2014

(65) Prior Publication Data

US 2015/0183100 A1 Jul. 2, 2015

(51) Int. Cl.

| | |
|---|---|
| ***B25B 23/16*** | (2006.01) |
| ***B25G 1/08*** | (2006.01) |
| ***B25G 1/10*** | (2006.01) |
| ***B25B 23/00*** | (2006.01) |

(52) U.S. Cl.

CPC ..... *B25G 1/105* (2013.01); *B25B 23/0042* (2013.01); *B25G 1/085* (2013.01); *Y10T 29/49822* (2015.01)

(58) Field of Classification Search

CPC .... B25B 23/16; B25B 23/0042; B25G 1/085; B25G 1/105; Y10T 29/49822

USPC ..... 81/177.5, 177.4

See application file for complete search history.

(56) References Cited

U.S. PATENT DOCUMENTS

| | | | | |
|---|---|---|---|---|
| 1,371,350 A * | 3/1921 | Campbell | B25B 13/463 | 81/177.4 |
| 2,593,828 A * | 4/1952 | Arey | B25B 13/56 | 81/174 |
| 6,260,452 B1 * | 7/2001 | Yu | B25B 23/0021 | 81/177.2 |
| 7,228,766 B1 * | 6/2007 | Shyu | B25B 13/005 | 81/125.1 |
| 8,387,490 B2 * | 3/2013 | Lee | B25G 1/043 | 81/177.7 |

* cited by examiner

*Primary Examiner* — Hadi Shakeri
(74) *Attorney, Agent, or Firm* — Fulwider Patton LLP

(57) ABSTRACT

A wrench comprising a bar extending between a left end and a right end, wherein the bar defines a left detent adjacent the left end, a right detent adjacent the right end, and a center detent in the center of the bar; a left handle removably attached to the left end, the left handle defining a chamber suitable for storing at least one socket; a right handle removably attached to the right end, the right handle defining a chamber suitable for storing at least one elongate extender element; a stub element configured at a first end to be slidingly attached to the bar, and configured at a second end to receive a socket, the stub element including a mating detent configured to sequentially mate with each of the left detent, the right detent, and the center detent as the stub element is slid along the bar.

1 Claim, 4 Drawing Sheets

ADJUSTABLE T-WRENCH

BACKGROUND

The present invention relates to wrenches with enhanced mechanical advantage, provided in combination with other useful features.

Wrenches are well known in the art for a variety of functions. One important kind of wrench is known as an X-wrench, which is typically used by motor vehicle owners. An X-wrench has a square cruciform shape and is used for removing nuts from the hub of a motor vehicle, in order to remove a wheel, typically a wheel with a flat tire. The cruciform X-shape is used so that the tip of each arm of the X may be provided with a socket of different size, so that up to four different socket sizes may be found on an X-wrench. Each socket is welded onto the tip of an arm, so that the socket sizes may not be changed. But, typically, the four socket sizes that are added to an X-wrench are sufficient to be applicable to the nut sizes found on most types of motor vehicle.

On the one hand, the X-wrench has some advantages, namely, multiple socket sizes usually mean that a suitable socket will be found on at least one branch. The cruciform shape allows a user to fit a socket over a wheel nut and exert a force couple to the nut by pulling on one arm of the X-wrench, and pushing on the other. As is known, a force couple does not apply any shear force to the nut, but applies only a pure moment for rotating the nut.

But on the other hand, an X-wrench has some disadvantages. First, the cruciform shape is unwieldy, and requires a large area in an automobile where it may be conveniently stores. Second, the cruciform shape provides the user with two arms for rotating a nut, and each arm is approximately eight inches long. Because there are two arms, a user may apply a bending moment via each arm, and this moment couple typically is sufficient to undo a nut. However, it frequently occurs that a wheel nut becomes stuck fast so that a user with ordinary physical strength cannot develop sufficient moment to undo the nut. In these circumstances, it is tempting for the user insert a socket over the nut, and to stand on one of the arms in order to generate a large counterclockwise moment on the nut. This introduces two problems. First, a large shear force and longitudinal bending moment is introduced into the nut, tending to bend the nut downwards. This may have catastrophic consequences, in that the nut may snap, or, if the nut is mounted on a stub, the stub may snap. Second, the user now has only one half of the moment arm that was available in the couple, namely the approximately eight inches available in a single arm.

Thus, there is a need in the art for a solution to problems encountered in wrenches configured for wheel nut removal. The present invention addresses these and other problems.

SUMMARY OF THE INVENTION

In some embodiments, the invention is a wrench comprising a bar extending between a left end and a right end, wherein the bar defines a center detent in the center of the bar and at least one of a left detent adjacent the left end, or a right detent adjacent the right end. A left handle is attached to the left end, the left handle defining a chamber suitable for storing at least one socket. A right handle is attached to the right end, the right handle defining a chamber suitable for storing at least one elongate extender element, wherein at least one of the left handle or the right handle are removably attached to the respective end of the bar. A stub element is provided, configured at a first end to be slidingly attached to the bar, and configured at a second end to receive a socket, the stub element including a mating detent configured to sequentially mate with detents defined by the bar as the stub element is slid along the bar. In some embodiments, the detents defined by the bar are each circular indentations in the bar. In this embodiment, the mating detent is a ball biased against the bar by a spring. In some embodiments, the left chamber is sealable with a left cap, and the right chamber is sealable with a right cap. In further embodiments, at least one of the left handle or the right handle includes a thread means for removable attachment to the bar.

In yet other embodiments, the invention is a method for removing a nut from a wheel using a wrench having handles at opposite ends of the wrench. The method comprises removing a cap from a handle positioned on the wrench; removing a socket from a chamber within the handle; positioning the socket on a stub element slidably positioned on a bar of the wrench; sliding the stub element to an end of the bar; removing from the bar a handle positioned adjacent the stub element; positioning the socket on the nut; and applying a force on the wrench thereby to remove the nut.

These, and other advantages of the invention, will become apparent when viewed in light of the drawings and the detailed description of the preferred embodiments.

DETAILED DESCRIPTION OF THE PREFERRED EMBODIMENTS

Figure 1:
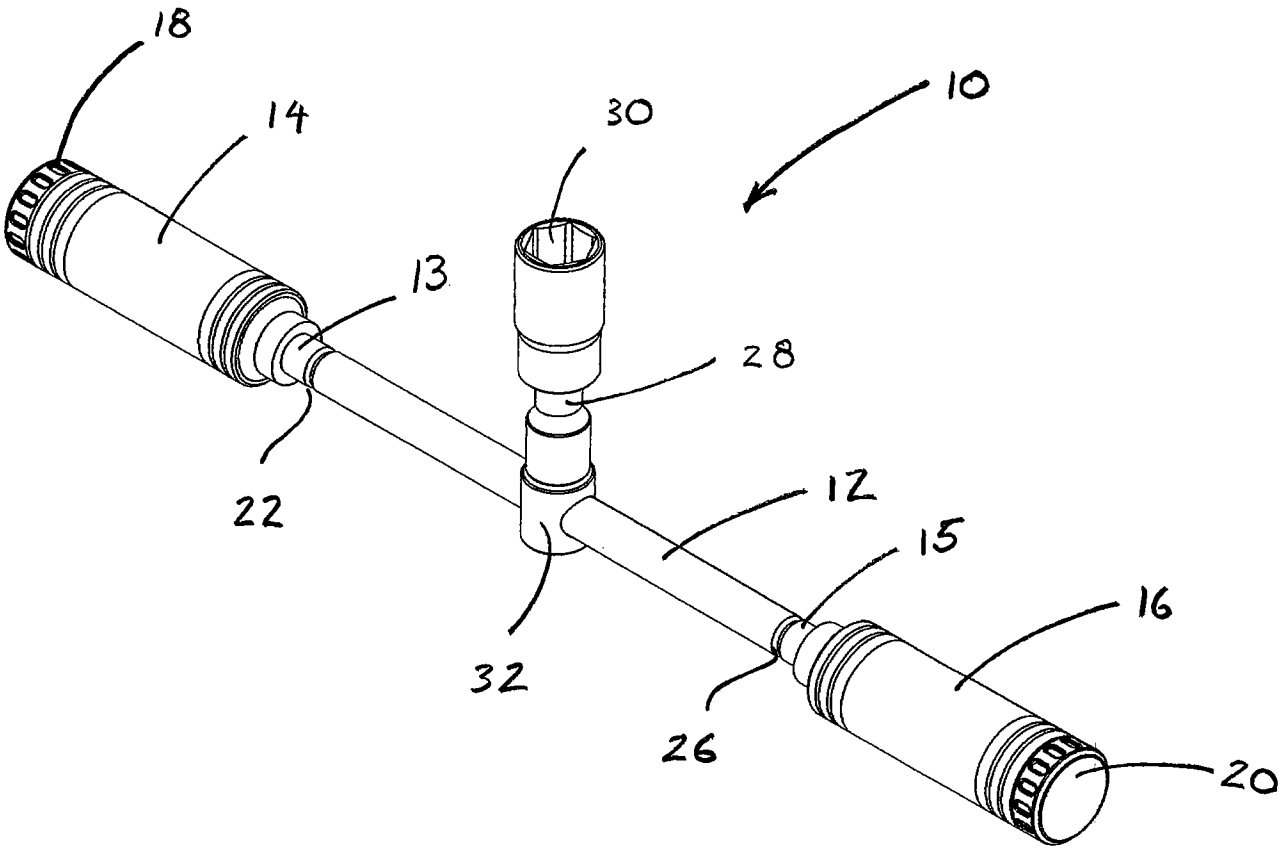
FIG. 1 is a perspective view of a T-wrench having features of the invention, shown in a first condition.

In conjunction with the drawings, embodiments of the invention are described. FIG. 1 exemplifies a T-wrench 10 configured to have features of the present invention. The T-wrench includes a longitudinal bar 12 extending between a left end 13 and a right end 15, which forms the main lever arm of the invention. At either end of the bar are positioned two elongate handles, a left handle 14 and a right handle 16. The handles are installed on the bar by threads 17 which permit a user to remove and attach the handles according to the needs of the situation, as described more fully below.

Figure 2:
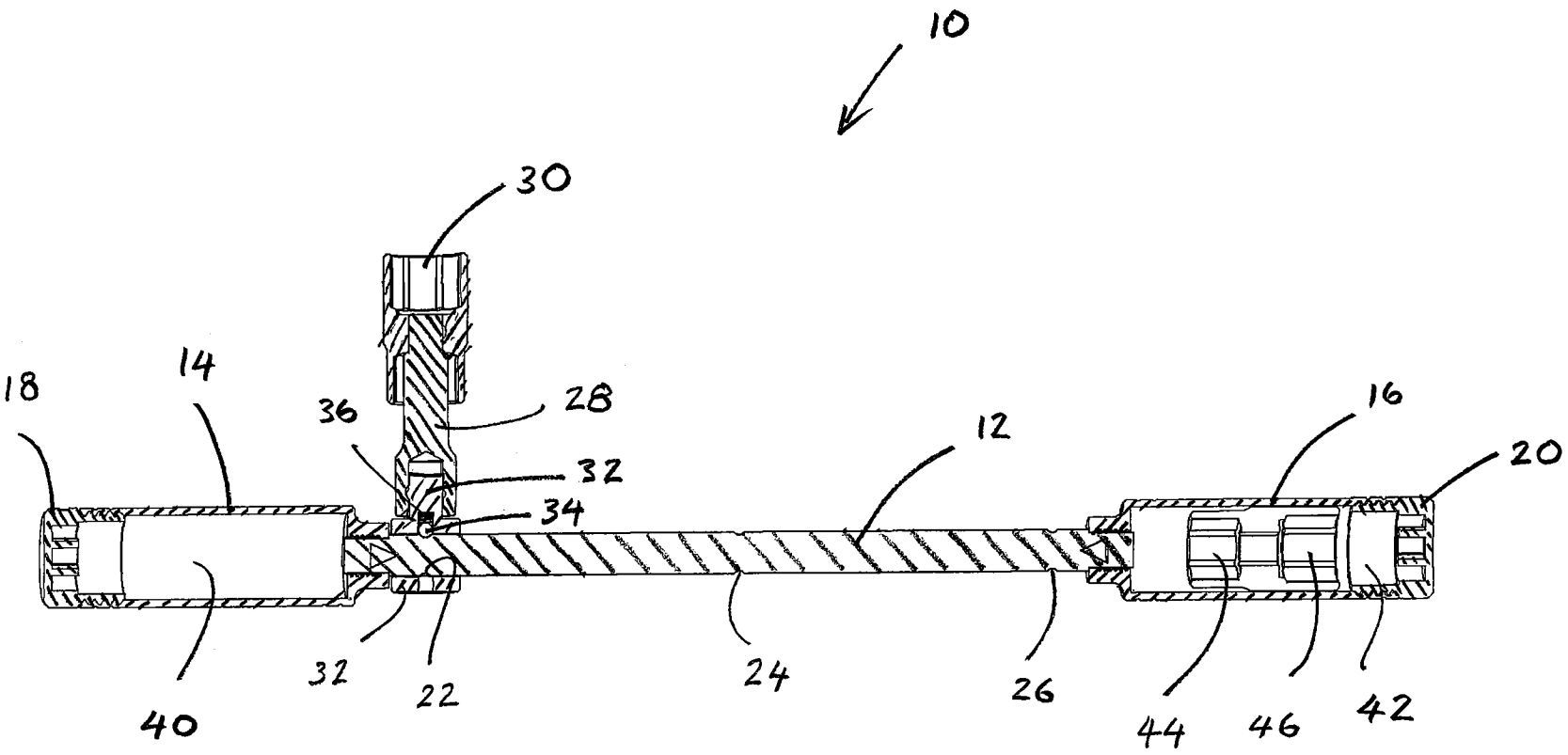
FIG. 2 is a sectional view of the T-wrench of FIG. 1, shown in a second condition.
Figure 3:
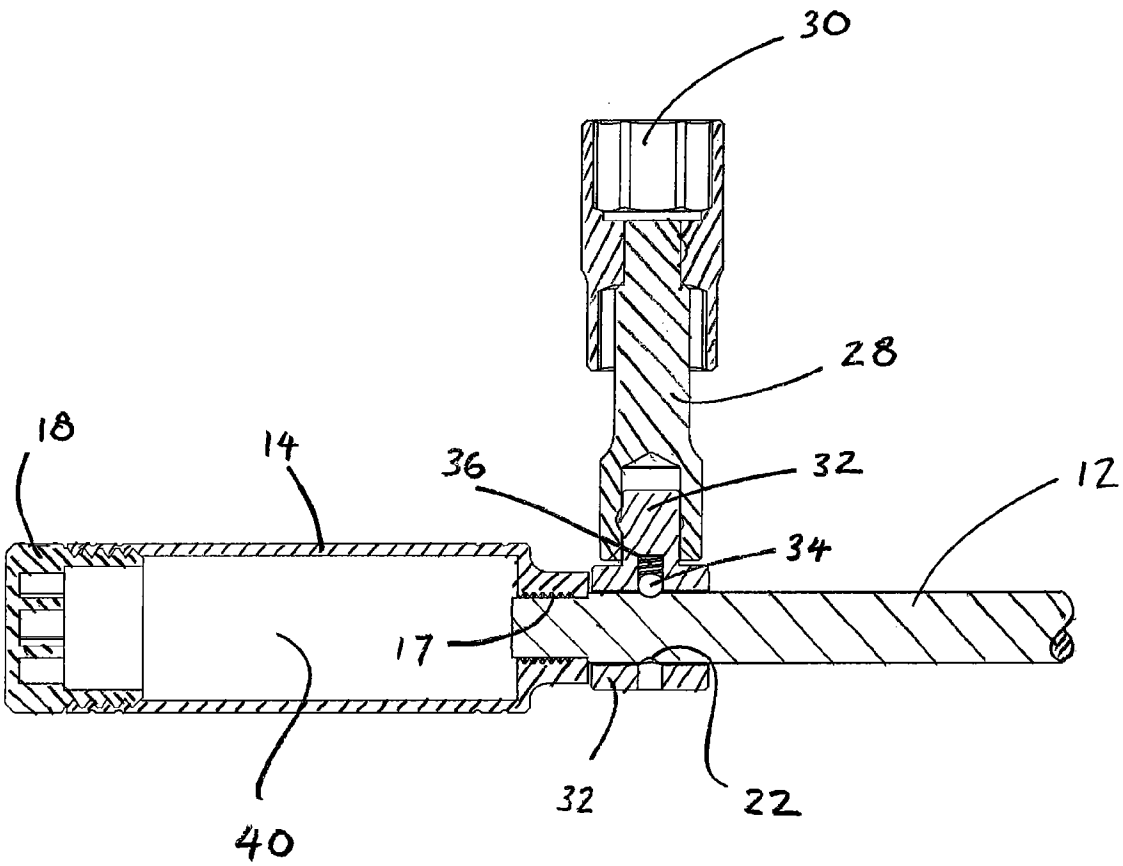
FIG. 3 is a detailed view of an aspect of the view of the T-wrench in FIG. 2.
Figure 4:
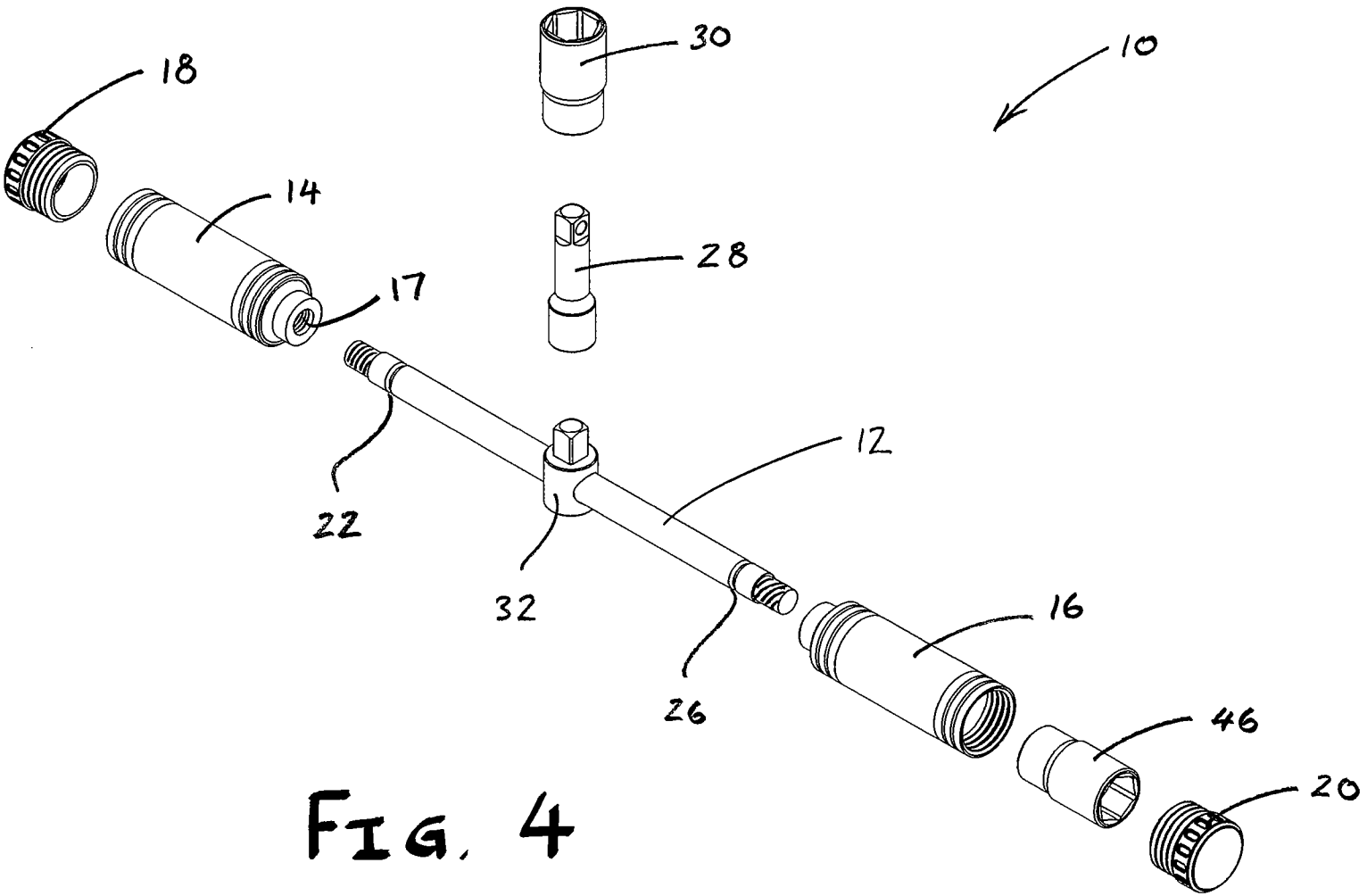
FIG. 4 is an exploded view of the T-wrench shown in FIG. 1.

In preferred embodiments, each handle 14, 16 defines a hollow cylindrical chamber 40, 42 respectively, each sealed by a threaded cap 18, 20 respectively, as exemplified in FIG. 2. In a preferred embodiment, the chambers 40, 42 in the handles 14, 16 may be used for storing a selection of sockets, exemplified by sockets 44, 46 in the right handle 16 and at least an extender element in the left handle, so that the T-wrench, when packed in the trunk of a car, includes all the necessary pieces required to use the T-wrench effectively.

Positioned on the bar 12 is a stub unit 32 which is configured at a first end to slide along the bar 12, and configured at a second end opposite the first end to have a square stub for receiving a socket 30. Optionally, an extension element 28 may be provided to be positioned between the stub 32 and the socket 30. Importantly, the bar is configured to have a plurality of detents 22, 24, 26, which in some embodiments, as exemplified, take the form of a circular depression in the bar. Positioned inside the stub a positive detent 34 may be provided, preferably in the form of a ball which is biased towards the center of the bar by a spring 36.

As a result of this configuration, the stub 32 may be slid along the length of the bar, until it reaches a position suitable for the user's purpose. If the position is adjacent one of the negative detents, then the two detents will snap into each other and hold the stub at the location of a detent.

As exemplified in FIG. 1, one detent 24 is preferably located at the center of the bar, another detent 22 at the left end of the bar and another detent 26 at the right end of the bar. Accordingly, the user may select to position the stub element in the center of the bar 12, or at an end of the bar. FIG. 1 shows the stub element carrying a socket in a first condition, positioned at the center of the bar. FIG. 2 shows the stub element having been slid to an end of the bar.

Thus, in use, a user may remove a cap 18 or 20, and select a socket. He may place the socket on the stub element 32 either with or without using an extension element 28. An extension element may be beneficial where the nuts are recessed on the wheel to make access by a socket without an extender element not feasible.

If the nut to be removed does not present a great deal of resistance, the user may find it easiest to position the stub element at the center of the bar. By fitting the socket 30 over the nut (not shown), the user may apply a moment couple through the wrench to rotate the nut in an anticlockwise direction where the nut is to be removed. The moment couple may be applied by lifting the right handle of the wrench upwards, while depressing the left handle of the wrench downwards.

However, if the nut to be removed presents a great deal of resistance, the user may not have sufficient strength to undo the nut. This may be especially possible where the user is a woman, or a person with impaired strength. In this event, the user may slide the stub element to an extremity of the bar (such as exemplified in FIG. 2), and then place the socket 30 over the nut. In this condition, the user may either: (a) position himself so that both his hands are positioned under the handle opposite the stub, and use the full strength and force of his or her body to lift the handle. This feature whereby the socket may be moved to an end of the handle gives the user a lever arm that is twice the single lever arm of the couple configuration (i.e. where the stub element 32 is positioned in the center of the bar), and allows the user to develop the full strength of his body in lifting the handle. Alternatively, (b) the user may place a foot on the handle opposite the stub element, and gently stand on the handle to apply his full actual weight in a downward direction. Typically, this provides a magnitude of force that exceeds the force that a normal person can apply using the force in his or her arms. This action also gives double the lever arm that would be available if the stub element were not adjustable along the length of the bar. It will be seen that the configuration of the present invention allows a user the option of applying a moment couple to the nut by using the strength in his or her arms, or alternatively, of applying the full body weight over an extended lever arm.

For best results, when the full length of the bar is being used as the lever arm, the extension element may be removed so that a minimum of bending moment is applied to the nut. It will be appreciated by those of skill in the art that, when an extension element is used, and a force is applied to only one arm of the bar, then a bending moment is applied to the nut which bends the nut along its longitudinal axis. (Not to be confused with the rotational moment for loosening the nut from its threads). The longer the extension element, the greater the longitudinal bending moment applied to the nut. Therefore, when a force is being applied to only one end of the arm, it is desirable not to use an extension element, so that the distance between the socket and the bar is reduced to the minimum length feasible.

Accordingly, in another aspect of the invention, at least one handle is configured to be removably attached to an end of the bar by threads 17 to permit being screwed onto the bar end. This feature allows the user to remove a handle as desired. This has utility in that, in certain configurations of vehicle wheels, it may be difficult to insert a socket onto a nut where the socket is very close to the bar—as would be the case where an extension element 28 is not used. This effect is typically caused by a cover plate on the wheel that surrounds the nuts and that causes the nuts to be recessed, so that the cover plate would conflict with the handle. Therefore, removing the handle avoids conflict between cover plate and handle, and allows a user to bring the bar 12 close to the nut without having to use an extension element. Once in position, without the handle, the user may apply full force to the bar and therefore apply a large rotational moment on the nut. This ability to remove the handle is a useful feature, and extends the possible uses of the wrench of the present invention.

Furthermore, the invention has the advantage of not being in an X cruciform shape, so that it may be reduced to a compact shape and stored in the trunk of a motor vehicle to take up much less space than the cruciform shape.

Thus, the various embodiments of the invention provides an advantageous structure for easily applying a large moment to a wheel nut in awkward situations. The present invention may, of course, be carried out in other specific ways than those herein set forth without departing from the essential characteristics of the invention. The present embodiments are, therefore, to be considered in all respects as illustrative and not restrictive, while the scope of the invention is set forth in the claims that follow.

I claim:

1. A method for removing a nut from a wheel using a wrench having handles at opposite ends of the wrench, the method comprising:

removing a cap from a handle positioned on the wrench;

removing a socket from a chamber within the handle;

positioning the socket on a stub element slidably positioned on a bar of the wrench;

sliding the stub element to an end of the bar;

removing from the bar a handle positioned adjacent the stub element;

positioning the socket on the nut; and applying a force on the wrench thereby to remove the nut.

* * * * *